United States Patent [19]

Hagendoorn

[11] 4,450,569

[45] May 22, 1984

[54] METHOD AND STRUCTURE FOR MAINTAINING EFFLUENT PRESSURE RANGE WITHIN AN ELECTRIC ARC MELTING FURNACE

[76] Inventor: Willem J. Hagendoorn, 1219 Constitution Dr., Louisville, Ky. 40214

[21] Appl. No.: 413,718

[22] Filed: Sep. 1, 1982

[51] Int. Cl.[3] ..... F27D 7/00

[52] U.S. Cl. ..... 373/9; 373/77; 373/78

[58] Field of Search ..... 373/8, 9, 81, 73, 78, 373/80, 77; 266/89

[56] References Cited

U.S. PATENT DOCUMENTS

| | | | |
|---|---|---|---|
| 3,453,369 | 7/1969 | Dock | 373/9 |
| 3,565,407 | 2/1971 | Schermer et al. | 373/80 |
| 4,242,532 | 12/1980 | Squibbs | 373/9 |

*Primary Examiner*—Roy N. Envall, Jr.
*Attorney, Agent, or Firm*—George C. Atwell

[57] ABSTRACT

A method is provided for maintaining a predetermined effluent gas pressure within an electric arc melting furnace of the type having an off-gas duct system. The method involves establishing, by simulation, correlations between specific measurable physical characteristics within the furnace and in the off-gas duct system and then utilizing these correlations to establish a program for automatically varying the volume of off-gas flow through the duct to maintain effluent gas pressure within a desired range within the furnace. Sensors are provided in the duct system to monitor the physical characteristics in the off-gas flow and for transmitting data to a microprocessor adapted to operate flow-regulating apparatus in the duct system to thereby maintain the pressure within the furnace within a predetermined range. The preferred structure for implementation of the disclosed method includes sensors on the duct structure for constantly monitoring variable physical characteristics of the effluent flow within the duct, and control means adapted to be responsive to signals from the sensors and to operate the draft regulating apparatus to vary the effluent flow through the duct and thereby maintain the effluent pressure within a predetermined range within the furnace.

7 Claims, 2 Drawing Figures

METHOD AND STRUCTURE FOR MAINTAINING EFFLUENT PRESSURE RANGE WITHIN AN ELECTRIC ARC MELTING FURNACE

BACKGROUND OF THE INVENTION

It is the common practice, in an industrial steel-making plant, to have melting furnace structure with an off-gas duct system for conducting gaseous effluent away from the furnace. The gaseous products from the furnace are caused to move through the duct system by the draft created from the high temperature melting process within the furnace and also by suction means, usually in the form of an industrial fan, provided upstream on the effluent processing system. It is of critical importance to maintain a constant negative pressure within the furnace during the melting process and it is typical to monitor the furnace internal pressure through the use of one or more sensors installed in the furnace roof. Data input from such pressure sensors can then be used to regulate the pressure within the furnace by regulating the volume of effluent flow through the duct system.

The problems of utilizing sensors in the furnace structure have long been recognized. Frequent repair or replacement of sensors is required because they are subjected directly to the extreme high temperatures and destructive action occurring within the furnace. Such problems can only be solved by the provision of a new and improved method and apparatus for monitoring the gaseous pressure within a melting furnace and maintaining the pressure within a desired range without subjecting the sensing and control components to the intense internal furnace environment.

SUMMARY OF THE INVENTION

This invention relates generally to basic metal processing equipment and the control of certain characteristics of the melting process, and pertains specifically to regulating internal gaseous pressure within a metal melting furnace.

This invention comprehends a new and improved method of maintaining a predetermined gas pressure range within a melting furnace by providing in the furnace duct structure, at a point relatively remote from the furnace shell, sensors to monitor the physical characteristics of the off-gas flow; establishing, by simulation, correlations between specific measurable physical characteristics in the furnace and the off-gas duct flow; and, by use of the correlations, indirectly influencing and controlling the pressure within the furnace through the adjustment of flow regulating means in the duct system in response to changes in the physical characteristics sensed in the effluent flow through the duct system.

The invention further comprehends sophisticating the method heretofore described whereby data transmitted by one or more sensors in the effluent duct system is electronically interpreted and processed, and means capable of varying the physical characteristics of the effluent flow are automatically constantly controlled to thereby maintain the pressure within the melting furnace in a predetermined acceptable range.

Apparatus for practicing the disclosed method may include adjustable damper structure in the off-gas duct of the melting furnace, appropriately placed downstream from pressure and temperature transmitting means, and control or regulating means operatively connected to the temperature and pressure transmitting means whereby the volume of effluent flow through the duct can be constantly varied to maintain a predetermined range of pressure within the furnace.

A feature of the present invention is the provision of the disclosed method and apparatus for its practice for use in maintaining a selected pressure range within two separate melting furnaces having off-gas duct systems which merge into a single common pollution control installation. It is contemplated that the method of the present invention could be applied to a multiplicity of melting furnaces having respective off-gas duct systems merging into a common pollution control system, assuming sufficient capacity in the design of the pollution control apparatus.

DETAILED DESCRIPTION OF THE PREFERRED EMBODIMENT

Figure 1:
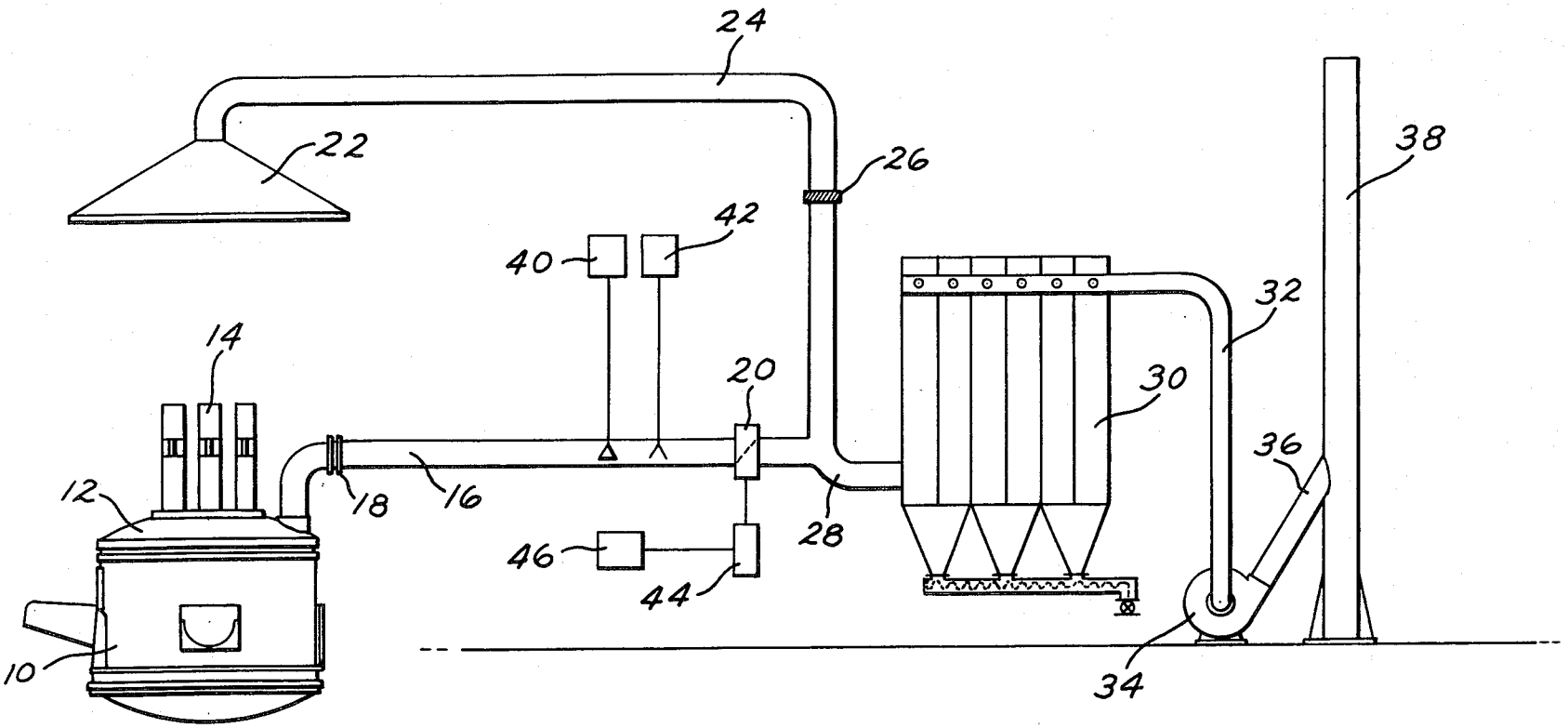
FIG. 1 is an elevational schematic representation of an electric arc melting furnace having an off-gas duct system leading to a pollution control installation, and illustrating the preferred placement of instrumentation in accordance with the present invention.

In accordance with the present invention, there is shown in FIG. 1 an electric arc steel melting furnace 10 having a removable roof 12 and vertically oriented electrodes 14 projecting downwardly through openings in the roof 12. The roof or lid 12 is provided with a "4th hole" or opening from which extends structure 16 which conducts gaseous effluent from the furnace 10. A gap 18 is provided in the duct 16 at a point adjacent to the roof 12 to enable roof removal when the furnace is recharged. Downstream from the gap 18 is located draft regulating means in the form of damper structure 20 for controlling the volume of effluent flow through the duct structure 16.

FIG. 1 also illustrates a canopy 22 disposed directly above the furnace 10 which serves to receive ascending effluent which escapes from gaps and crevices in the furnace structure. The canopy 22, which will also take in relatively cool ambient air, is coupled to duct structure 24 having along its length a draft regulating means in the form of damper structure 26. Although not illustrated, it should be understood that duct structure 16 is provided with a coolant flow jacket along its entire length to preserve its integrity and prevent its disintegration from the extremely high temperatures of continuous combustion which occurs therein. Duct structures 16 and 24 merge into a common duct 28 leading to particulate matter filtering equipment or baghouse 30. Leading from baghouse 30 is a duct 32 which conducts the gaseous effluent through a suction fan 34 and thence through a duct 36 to an exhaust stack 38.

The duct structure 16 serves also as a combustion chamber to prevent explosive buildup of effluent constituents. Burnoff or transformation of hydrocarbons in the effluent occurs constantly in duct 16 during the melting furnace operation.

FIG. 1 also illustrates the provision, in duct 16, of temperature sensing and transmitting means 40, which may be a thermocouple operatively connected to a temperature transmitter, and pressure sensing and transmitting means 42 which may be in the form of a pressure sensing probe in the duct 16 operatively connected to a remotely located transmitter. Also shown in FIG. 1 is a damper operator 44 operatively connected to a controller 46.

By reference to FIG. 1, the following explanation of the method employed in the present invention will be understood by persons skilled in the art. Such persons familiar with electric arc furnaces and their operation are aware that such furnaces are designed to maintain a constant negative pressure under the furnace roof in order to ensure a constant indraft of ambient air into the furnace shell through the angular roof gap, the slagdoor gap, and the clearance openings around the electrodes, etc. Maintenance of the desired negative pressure within the furnace has heretofore been dependent upon the use of a pressure sensor or probe installed in the furnace roof. Such instrumentation has a very short useful life due to the intense internal furnace environment during the melting operation, it being quite common for a sensor to be disabled by melt splash or slag or other occurrences within the furnace. The present invention results from a recognition of the need for providing control sensors in a less severe environment which will nevertheless be able to sense furnace operating conditions. By mathematical modeling technique it was determined that a location for such sensors could be established in the direct evacuation control duct system of the furnace, at a point downstream from the damper structure in the duct which is normally utilized for regulating the volume of effluent moving through the duct. This location has the advantage of being relatively easy to service because the damper and the related instrumentation can be placed in a section of water-cooled duct which can be easily removed and replaced, yet will require servicing comparatively less often because the environment is comparatively less severe.

Anyone technically trained in the technique of mathematical modeling will appreciate how, by simulation, the physical characteristics which occur in the duct system can be correlated to certain physical characteristics which occur in the furnace during the melting process. During the furnace operation, the flow of off-gases is primarily affected by the heat energy generated in the furnace. Such heat energy is primarily generated by the furnace electrodes and by oil burn from scrap charged for melting into the furnace, with the latter source being the most variable. Oil burn, then, was used as a controlled variable in a mathematical model, and the negative pressure in the furnace was maintained as a constant to generate data which reflects effluent characteristics in the duct system just upstream from the damper structure, as hereafter set forth:

| Furnace Oil Burn (BTU/min.) | Off-Gas Temperature °F. | Off-Gas Pressure Neg. Inches WG | Mass Flow (CFM/min.) |
|---|---|---|---|
| 0 | 483 | 1.05 | 1342 |
| 10 | 744 | 1.827 | 1616 |
| 20 | 925 | 2.695 | 1859 |
| 30 | 1021 | 3.553 | 2072 |
| 40 | 1249 | 4.24 | 2168 |
| 50 | 1382 | 4.84 | 2254 |

With statistical data analysis (linear regression) techniques, it was then determined that the above data has a paired linear interrelationship with a correlation factor of 0.98 or higher. Once it has been established that there is a direct proportional relationship between measurable physical characteristics in the furnace with those in the duct system, it is apparent that pressure within the furnace can be controlled within an acceptable range by controlling one or more of the characteristics or conditions occurring in the duct system. Pressure in the duct system can be controlled by selective positioning of a draft-regulating means such as the damper 20 shown in FIG. 1. By holding furnace indraft conditions constant, only the heat energy released in the furnace determines gas mass flow, pressure and temperature conditions in the duct system. In the duct system, as the heat energy released from the furnace changes, corresponding changes occur in gas mass flow, temperature and pressure. With a computer model study, it has been determined that for a given heat energy release from the furnace, such factors as temperature, static pressure in the duct, and the mass flow of gases there-through at a given point have a paired linear relationship. It will thus be seen, with reference to FIG. 1, that by monitoring temperature as a controlled variable and adjusting the damper 20 to provide a corresponding negative pressure in the duct, internal furnace pressure can be maintained at a comparatively steady range or level.

The level of negative pressure in the furnace is so selected as to provide adequate indraft through the roof gap and the openings around the electrodes to prevent emission from the furnace during the melting cycle and the other various operating phases of the furnace.

Figure 2:
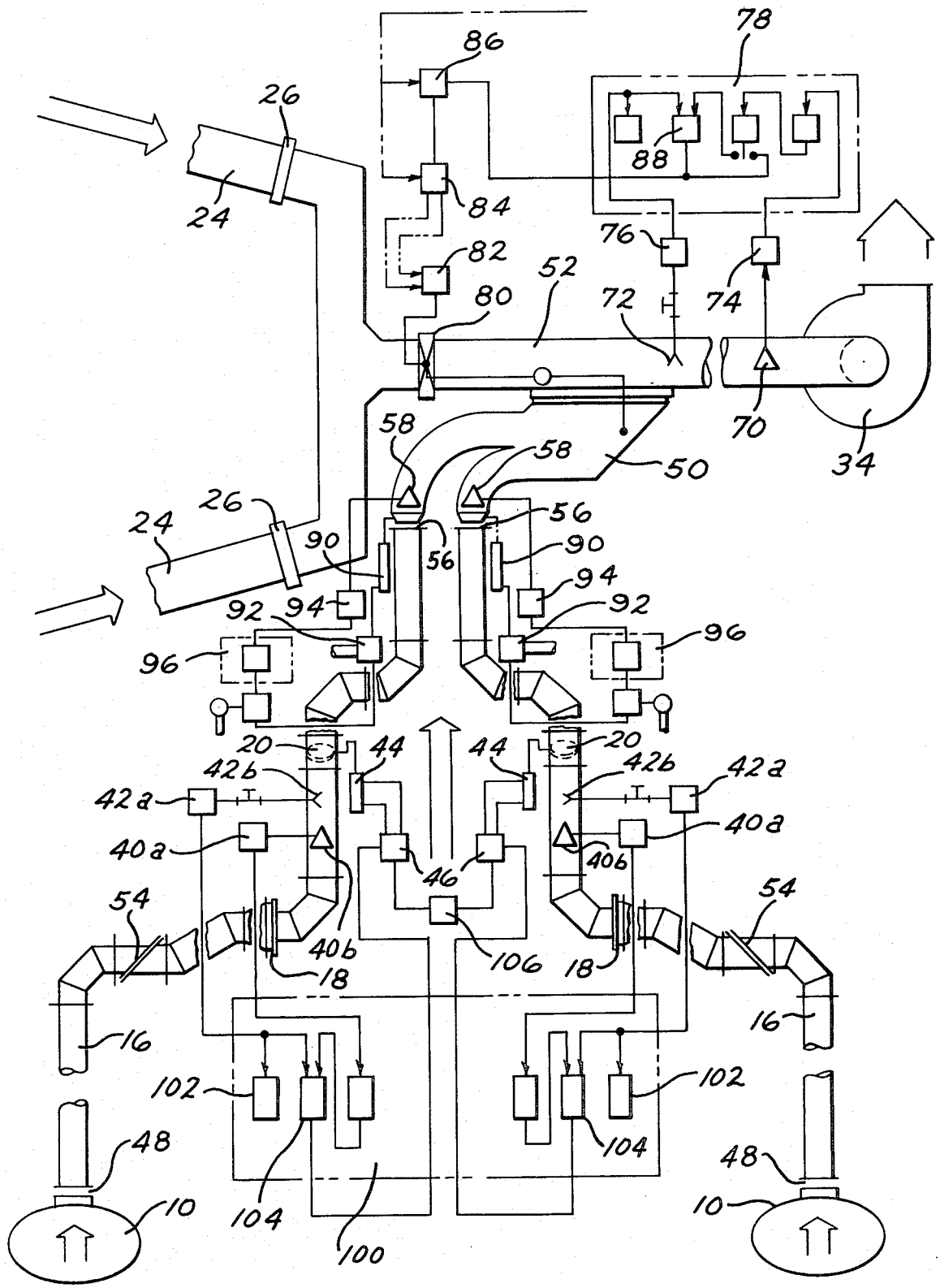
FIG. 2 is a schematic representation illustrating the instrument loops utilized in practicing the present invention when applied to a dual melting furnace installation.

As a prerequisite to understanding the significance of the illustration in FIG. 2, further reference should be made to FIG. 1, and particularly the canopy 22. It is common practice to provide such a canopy to handle gaseous fumes which move upwardly from the furnace particularly when the roof 12 is removed. The overhead canopy and the duct system, in combination, serve to channel substantially all furnace emissions to pollution control equipment, and the canopy duct system also serves to provide quench air which intermixes with the substantially higher temperature air from the off-gas duct system, whereby the effluent temperature going to the baghouse can be maintained within a comparatively low temperature range. The concept of channeling all emissions into a single large baghouse, by utilizing two collection systems for a single furnace (the overhead canopy and the direct off-gas duct system) is already known in the art. The present invention, however, comprehends directing the emissions from at least two furnaces, each having its own off-gas duct system and canopy collection system, into one pollution control installation comprising, for example, a baghouse and fan with the capabilities to process the emissions received.

In FIG. 2, where illustrated components or elements which are the same as those first shown in FIG. 1 are given like numeral designations, two furnaces 10 are arranged to have all emissions therefrom channeled to a common suction fan 34 and thence to other common pollution control equipment, such as a baghouse (not shown). Each furnace 10 is provided with an overhead canopy (not shown) receiving ambient emissions and channeling them through corresponding ducts 24, each having a controllable damper 26. Each furnace 10 also has its own off-gas duct system 16 channeling effluent flow directly from the furnace to a common plenum 50 which channels the united flow from both duct systems 16 to a central collecting duct 52. The duct 52 constitutes a unitary merger of the canopy ducts 24 and directs all furnace emissions collected by the various described systems to the pollution control equipment for particulate matter removal prior to exhaustion of cleansed gaseous flow into the atmosphere.

Although the off-gas duct systems 16 for the two furnaces 10 shown in FIG. 2 are identical, they are modified somewhat with respect to the illustration of FIG. 1. In FIG. 2, each duct system 16 has the characteristic "4th hole" gap at the point of connection between duct 16 and the furnace roof. Further downstream in the duct 16 is a gap 54, and still further on is a gap at 18 which is substantially identical to the gap 18 in FIG. 1. The instrumentation first identified in FIG. 1 as temperature sensing means 40 and pressure sensing and transmitting means 42 is shown in FIG. 2 as comprising a temperature transmitter 40*a* interconnected with a thermocouple 40*b*, and a differential pressure transmitter 42*a* interconnected to a probe 42*b*.

Further downstream from the aforedescribed instrumentation is the damper structure 20 and, at the point where the duct system 16 enters the plenum 50, a selectively variable gap 56 is provided. Although specific structure for varying the gap 56 is not shown, it is common in the art to provide a means of introducing ambient air near the termination of the fluid cooled duct as a means of reducing the flow temperature so components thereafter receiving the flow, which are not specially cooled, will not be heated beyond their capability. Regulating the size of the gap opening is usually accomplished by having a ring-like segment which can be moved a desired distance from a complimentary shaped opening in the duct structure to control the amount of inflow ambient air. A thermocouple 58 is provided in the plenum entry to monitor the temperature of the flow entering the plenum and thereby control the mix of gaseous effluent and ambient air to prevent overheating of the plenum.

The duct 52 leading to the suction fan 34 is provided with means to monitor its temperature and pressure in the form of a thermocouple 70 and a pressure probe 72 operatively connected, respectively, to a temperature transmitter 74 and a differential pressure transmitter 76. Signals transmitted by the instruments 74 and 76 are received in a control room 78. The duct 52 is provided with a controllable damper structure 80 having a pneumatic operator 82 operatively connected to an actuator 84. An electrical pneumatic transducer 86 is electrically impulsed from the control room by a current-adjusting-type controller 88. The damper 80 is adapted to be automatically controlled, in response to pressure or temperature changes detected in the duct 52 to provide the required incoming volume of quench air from the canopy ducts 24 to maintain the desired temperature in the gaseous flow going to the suction fan.

The canopy air intake dampers 26 are operated in conjunction with the furnace roofs. If the roof beneath a particular hood is open, the corresponding damper in the canopy duct will be open to allow maximum flow to capture emissions released during charging or other operations being performed on the open furnace. These dampers are provided with partial or undersized shutters (not shown) so they cannot completely block air flow in view of the fact that quench air is always required if baghouse temperatures are to be maintained at a safe level, usually below 275° F. The main canopy flow control damper 80 is controlled so it will maintain a set negative pressure adjacent the plenum from which the furnace off-gases are drawn, regardless of the disposition of the dampers 26. It is also provided (by means not shown) that an alarm would be triggered in the control room 78 whereby the damper 80 would open completely to draw maximum quench air into the system if the temperature of gaseous flow to the baghouse would exceed the predetermined safe level.

As shown in FIG. 2, there are four main control points for handling furnace emissions in the total installation, which are the fluid-cooled damper structures 20, the controllable gap 56, the canopy air off-take dampers 26, and the main canopy control damper 80.

The controllable gap 56 assures that the mild steel plenum 50 and duct 52, which receive gaseous flow from the fluid-cooled ducts 16, will not receive gaseous flow at destructively high temperatures. Appropriate ambient air is bled into the system through the gap 56 when the temperature of the gases adjacent the gap reach 900° F. Control of the opening or gap 56 is through a pneumatic operator 90 operatively connected to a pneumatic cylinder actuator 92. The thermocouple 58 is connected to a temperature indicator 94 having alarm contacts, and a control room 96 is provided to house a current-adjusting-type controller which will actuate a converter interconnected to the cylinder actuator 92.

For the fluid-cooled dampers 20 in the respective ducts 16, a central control room 100 is provided wherein such instruments as a pressure indicator 102 and a current-adjusting-type controller 104 are preferably disposed. Although each damper 20 in the disclosed two-furnace arrangement is provided with its own independent control system, the damper control equipment can be fed by a single common hydraulic supply 106.

It should now be apparent that controlling the desired negative pressure within a melting furnace may be accomplished by a programmed method of controlling directly related off-gas flow physical characteristics and thus obviate the need for taking pressure readings directly at the furnace shell. Heretofore, reading pressure in the furnace shell has been common practice even though sensing equipment is not only susceptible to damage but is also subject to pressure fluctuation so intense that flow volume regulating means in the off-gas duct cannot mechanically react fast enough to the incoming signals. This results in undesirable oscillations which the equipment cannot long withstand. The present invention solves these problems and enables significant corresponding financial savings.

The instrumentation of the disclosed method and means for maintaining a desired negative pressure range in a melting furnace may, as described particularly with reference to FIG. 2, be integrated with other control instrumentation of the various systems in the furnace installation, and may also be adapted for use in a plural furnace arrangement utilizing a single cleaning device for removing pollutants from the furnace emissions. With respect to FIG. 2, it should be noted that the operation of mechanical components and instrumentation which is duplicated on duplicate systems for the two furnaces shown, would be identical, so repetitive description of the operation of duplicate equipment has been avoided herein.

The method of the present invention and the instrumentation and apparatus for its practice, as described herein and illustrated in the accompanying drawings, is provided to demonstrate a presently preferred embodiment of the invention and is not intended to limit, in any way, the scope of the invention. It is contemplated that persons skilled in the art may variously adapt the invention in light of the teachings herein. Accordingly, it is anticipated that changes and modifications may be made without departing from the spirit and scope of the invention as defined in the appended claims.

I claim:

1. In metal melting furnace structure of the type having an off-gas duct system with duct-cooling means and variable flow-regulating means for varying the volume of off-gas flow through the duct, a method of maintaining a predetermined gas pressure range within the furnace comprising the steps of:

establishing, by simulation, correlations between specific measurable physical characteristics within the furnace and in the off-gas duct system;

providing instruments on the duct system to monitor the physical characteristics of the off-gas duct flow; and utilizing the correlations to establish a program for automatically signaling and controlling the flow-regulating means in response to data transmitted by the instruments to thereby indirectly maintain a predetermined pressure range within the furnace.

2. The method of claim 1 further including the step of constantly interpreting the data transmitted by the instruments and controlling the variable flow-regulating means by use of programmed electronic processing equipment.

3. A metal melting furnace installation having an off-gas duct structure for conducting gaseous effluent away from the furnace, a draft-regulating means within the duct for selectively varying the rate of effluent flow through the duct, sensors on the duct structure for constantly monitoring variable physical characteristics of the effluent flow within the duct, and program-reactive control means operatively connected to the draft-regulating means and adapted to electronically interpret and process data transmitted from the sensors pursuant to a pre-established program utilizing correlations between furnace internal and off-gas duct structure physical characteristics and thereby automatically operate the draft regulating means to maintain static pressure in the furnace within a preferred range.

4. The invention of claim 3 wherein the sensors on the duct structure include a thermocouple for sensing temperature of the effluent flow within the duct and a probe for sensing gas pressure within the duct.

5. The invention of claim 4, wherein the control means is responsive to temperature and pressure changes detected by the thermocouple and probe to actuate the draft-regulating means.

6. An electric arc melting furnace installation comprising a plurality of electric arc melting furnaces, each furnace having a fluid-cooled off-gas duct system and a canopy air duct system, a pollution control system adapted to receive and process gaseous flow from all the duct systems of the furnaces, draft-regulating means in each duct system, and control means operatively-connected to each draft-regulating means to control the volume of flow through the duct systems.

7. The invention of claim 6 wherein each duct system has sensors disposed thereon to monitor temperature and pressure of gaseous flow through the duct, and the control means being adapted to respond to data transmitted from the sensors and actuate the draft-regulating means to maintain a predetermined pressure range within the furnace from which the duct system receives gaseous flow.

* * * * *